United States Patent [19]

Snowden et al.

[11] Patent Number: 4,526,277

[45] Date of Patent: Jul. 2, 1985

[54] HANGING FOLDER FRAME SUPPORT

[75] Inventors: Wesley R. Snowden, Etobicoke; Erhard P. Walter, Brampton, both of Canada

[73] Assignee: Corvent International Limited, Brampton, Canada

[21] Appl. No.: 531,008

[22] Filed: Sep. 12, 1983

[51] Int. Cl.[3] ..... A47F 7/16

[52] U.S. Cl. ..... 211/46; 312/184

[58] Field of Search ..... 211/46, 45; 312/184; D19/90

[56] References Cited

U.S. PATENT DOCUMENTS

| | | | |
|---|---|---|---|
| 670,789 | 3/1901 | Knoder | 211/105.3 |
| 2,852,028 | 9/1958 | Patterson | 312/184 X |
| 3,848,748 | 11/1974 | Ceccarelli | 211/46 X |
| 3,999,663 | 12/1976 | Walter | 211/46 X |
| 4,030,610 | 6/1977 | Alexander | 312/184 X |
| 4,295,571 | 10/1981 | Meyer | 211/46 X |

FOREIGN PATENT DOCUMENTS

| | | | |
|---|---|---|---|
| 1091119 | 12/1980 | Canada | 211/46 |

*Primary Examiner*—Ramon S. Britts
*Assistant Examiner*—Sarah A. Lechok

[57] ABSTRACT

The present invention relates to an arrangement for hanging folders including an upright support for a pair of rails spaced apart to receive the folders. In one upright position of the structure the rails are supported at a first spacing for hanging folders of one size and when the structure is inverted the rails are supported at a second spacing different from the first spacing for hanging folders of another size.

15 Claims, 14 Drawing Figures

FIG. 1.
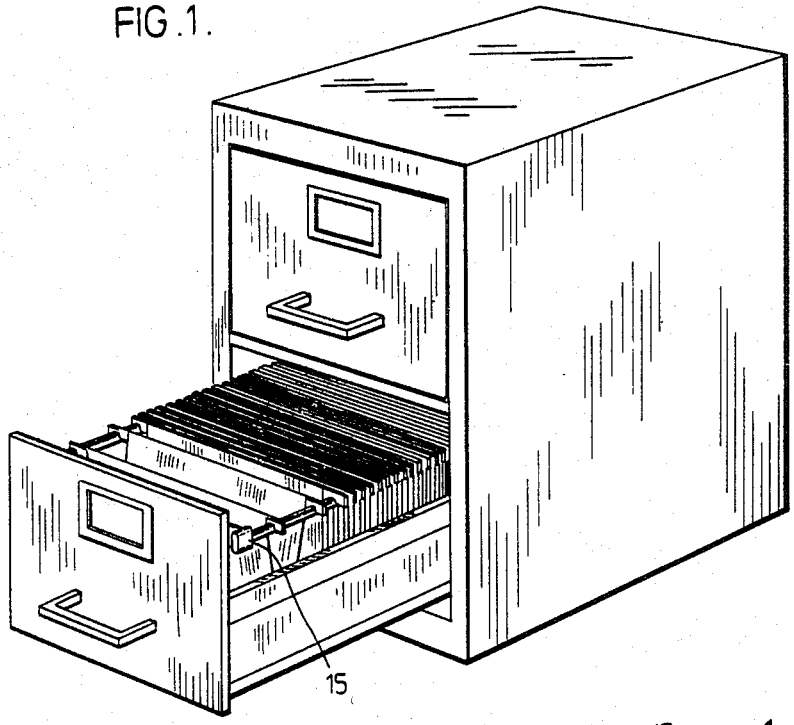
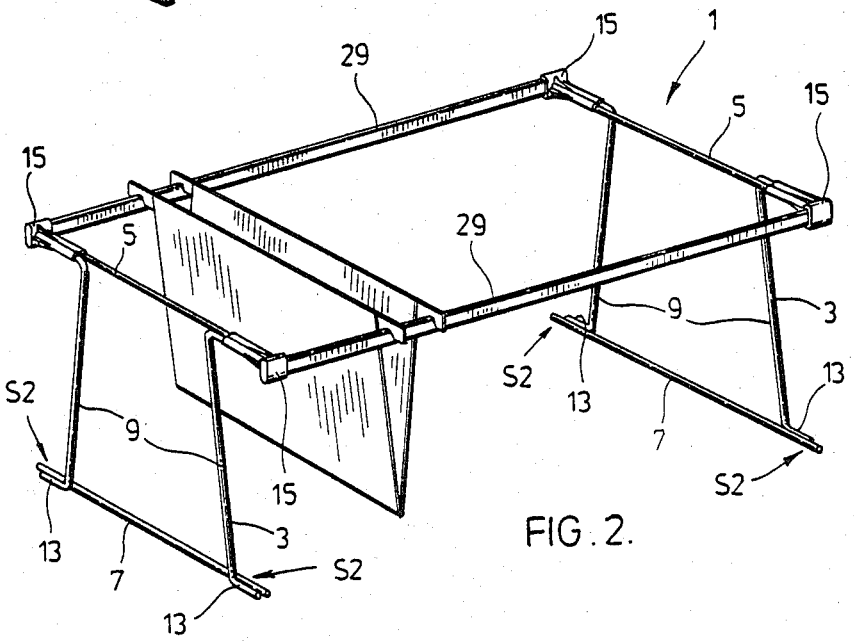
FIG. 2.

FIG. 5.
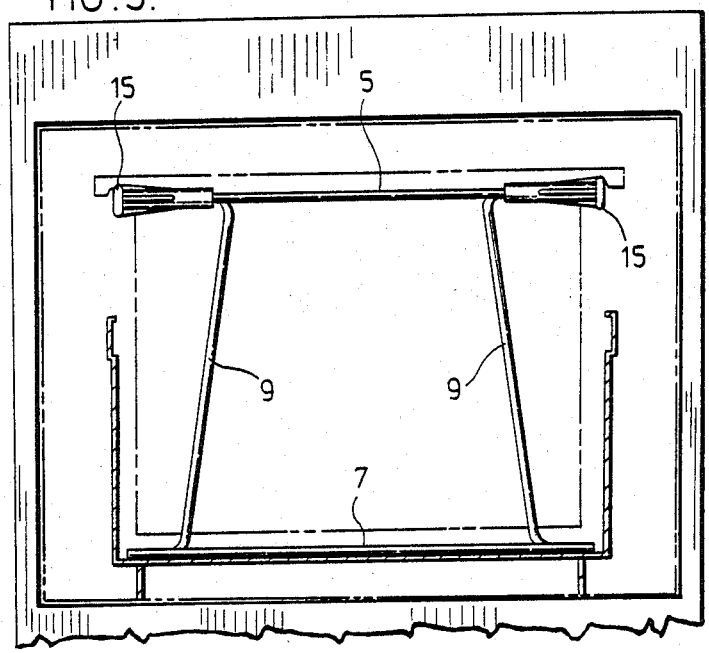
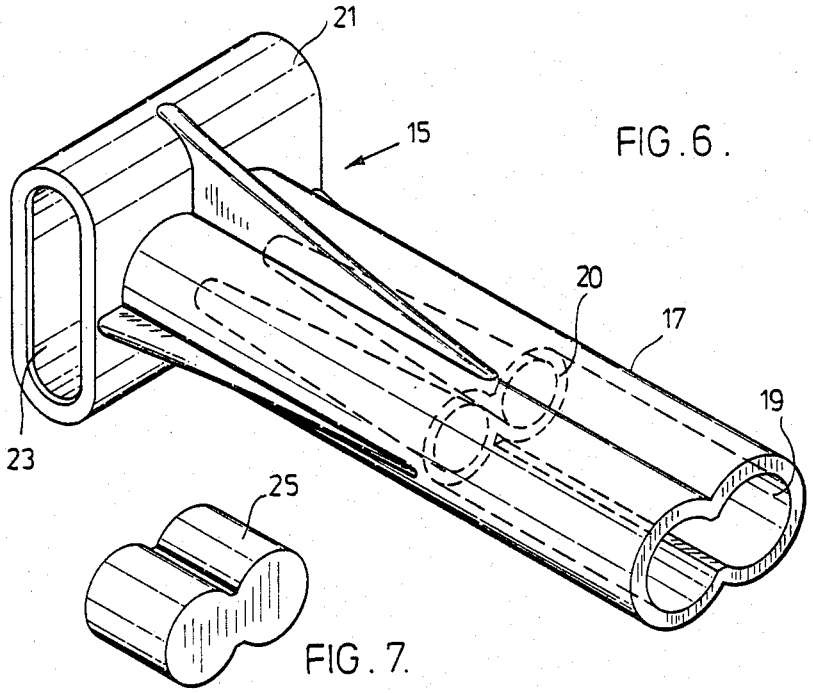
FIG. 6.
FIG. 7.

HANGING FOLDER FRAME SUPPORT

FIELD OF THE INVENTION

The present invention relates to a knockdown hanging folder arrangement which can be assembled in a number of different manners to support different sizes of hanging folders in different sizes of file cabinets.

BACKGROUND OF THE INVENTION

There are presently available, different types of hanging folder frames which can be adjusted for different sizes of hanging folders. A typical arrangement is one which includes telescopic support frame members which telescope to different positions for adjustment of the arrangement.

In this prior art arrangement the telescopic frames are somewhat complex making them both costly and awkward to work with. For example, they may lock in a specific position from which they are difficult to release. If the locking positions are worn, they will not effectively provide an adjustment stop so that it becomes difficult to accurately adjust the system to accommodate a specific size of hanging folder.

Secondly these telescopic frames include inherent structural weaknesses as a result of the moving parts required to make the frames telescope. Accordingly they are often rickety which is highly undesirable for supporting heavy loads of hanging folders.

SUMMARY OF THE PRESENT INVENTION

The present invention provides a structure which is inexpensive and simple relative to the prior art arrangements discussed above. However, at the same time the structure of the present invention is extremely efficient and sturdy for the supporting of hanging folders.

More particularly the present invention provides an invertible structure for use as an upright support in supporting side rails for hanging folders from the side rails. When the structure is upright it has vertically spaced ends with first horizontally spaced support means adjacent one end and second horizontally spaced support means of different spacing from the first horizontally spaced support means adjacent the other end.

According to this arrangement the structure of the present invention is adapted to provide support of the side rails in one spaced relation by the first horizontally spaced support means for hanging folders of one size in one upright position and to provide support of the side rails in a different spaced relation by the second horizontally spaced support means for hanging folders of a different size when the structure is inverted.

The upright support structure itself includes no moving parts so that it is uncomplicated in its construction. This provides substantial benefits from both a cost and a strength standpoint. Furthermore the repositioning of the rails to accommodate different sizes of hanging folders is a simple operation when working with the structure of the present invention.

According to an aspect of the present invention the structure is specifically designed to accommodate either letter or legal sized hanging folders with the second horizontally spaced apart support means being spaced for supporting the rails to hang the legal size folders in a legal size cabinet and at the same time being spaced to fit within a letter sized filing cabinet when the structure is inverted and the rails are supported to hang letter size folders.

BRIEF DISCUSSION OF THE DRAWINGS

The above as well as other advantages and features of the present invention will be described in greater detail according to the preferred embodiments of the present invention in which:

FIG. 1 is a front perspective view looking down on a filing cabinet fitted with a folder hanger arrangement with folders supported therefrom according to a preferred embodiment of the present invention;

FIG. 2 is aa perspective view of one assembly of the folder hanger arrangement of FIG. 1, removed from the cabinet and substantially free of folders;

FIG. 5 is an end view from the inside of a letter sized filing cabinet with the folder hanger arrangement assembled in the FIG. 2 position;

FIG. 6 is an enlarged perspective view of a connecting member for connecting the rails and the supporting structure as used in either of the folder hanger arrangements of FIGS. 2 and 3;

FIG. 7 is an enlarged perspective view of an adaptor plug which is useable with the connecting member of FIG. 6 to accommodate a different size hanging folder from those shown in FIGS. 2 and 3;

DETAILED DESCRIPTION ACCORDING TO THE PREFERRED EMBODIMENTS

Figure 3:
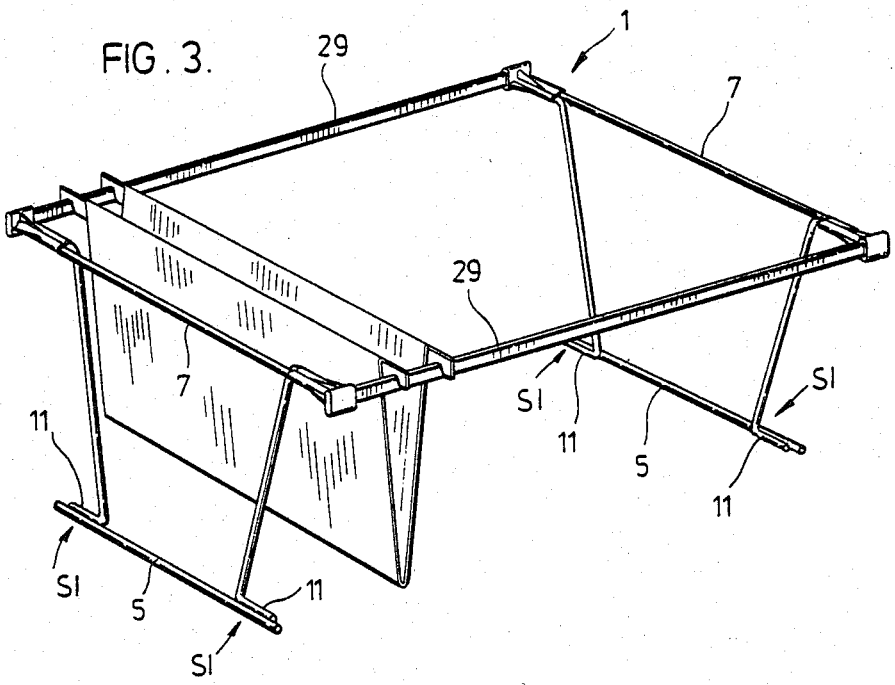
FIG. 3 is a perspective view of an alternate assembly with the supporting structure inverted from that shown in FIG. 2.
Figure 11:
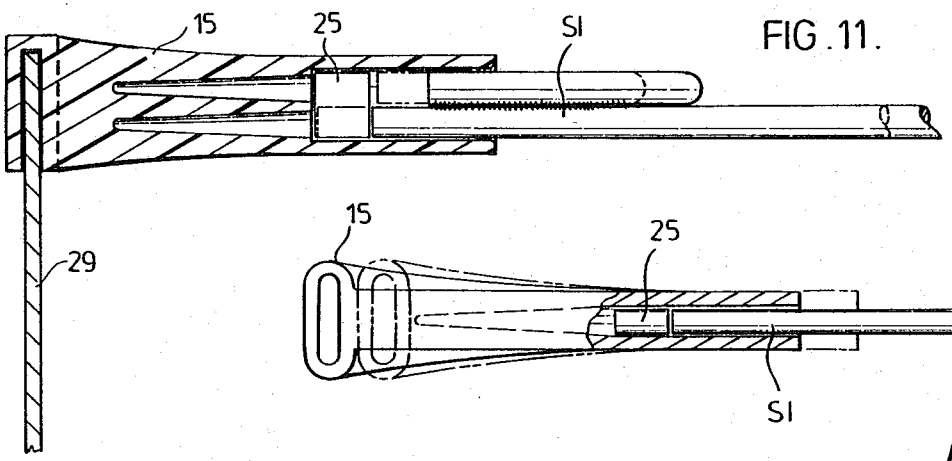
FIG. 11 is a view similar to FIG. 8 arranged for metric sized folders.
Figure 12:
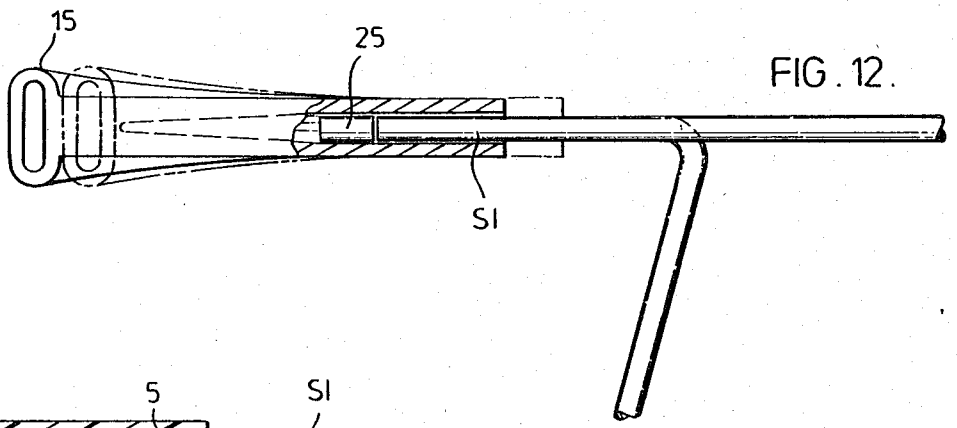
FIG. 12 is again a view similar to FIGS. 8 and 11 showing a comparison of the fitting of the connecting member in the metric and the letter size hanging folder positions.

FIGS. 2 and 3 show a knockdown folder hanger arrangement which includes two upright support frame members 3, four connecting members 15 and a pair of elongated rails 29. In FIG. 2 the arrangement is assembled for hanging letter size hanging folders whereas in FIG. 3 the arrangement is assembled for hanging legal size hanging folders. FIGS. 11 and 12 show a further set-up where the arrangement is arranged for hanging metric size hanging folders which are larger than letter and smaller than legal size folders.

Figure 4:
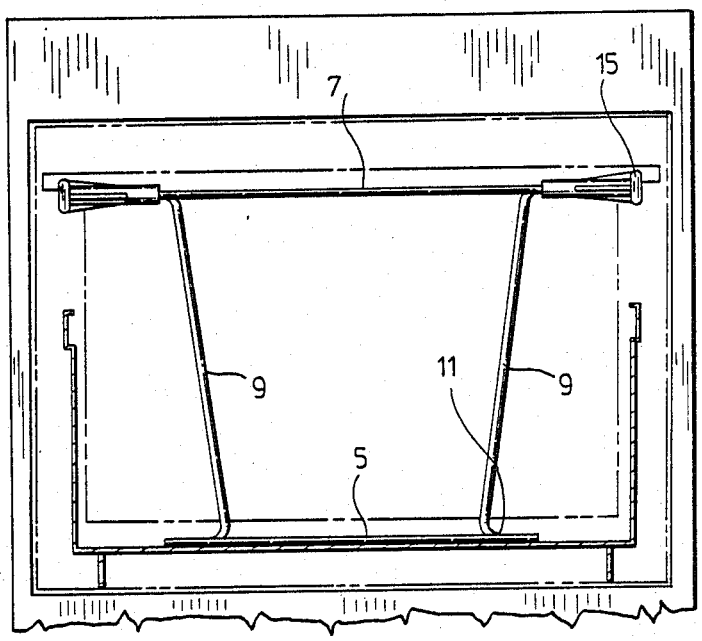
FIG. 4 is an end view from the inside of a legal sized filing cabinet with the folder hanger arrangement assembled as shown in FIG. 3.

The folder hanger arrangement shown in the drawings is one which can be used independently or can be set up as shown in FIG. 1 in a filing cabinet. In FIG. 4 the arrangement is set up for hanging legal size hanging folders in a legal size filing cabinet whereas in FIG. 5 the set up is arranged for hanging letter size hanging folders in a letter size filing cabinet.

As mentioned above, the arrangement is knockdown so that the upright frame members, the connecting members and the rails are all totally separable from one another however, all of these components are easily interfitted for assembly of the arrangement with the frame members being constructed for inverting to enable different assemblies of the arrangement according to the size of hanging folder to be used with the arrangement.

More particularly each of the frame members 3, which acts as an upright support structure for the entire arrangement, includes first and second horizontally spaced support means in the form of two sets of supports S1 and S2 as seen in FIGS. 2 and 3. These sets of supports are at the vertically spaced ends of the upright frame members which are designed for switching of the up and down positioning of each of the sets of supports. For example, in FIG. 2, the frame members are in a first upright orientation where sets of supports S1 are in an up position for supporting the rails to receive the letter size hanging folders. In FIG. 3 the frame members are inverted to a reversed upright orientation to switch the positions of the supports so that supports S2 are in the up position for supporting the rails to receive the legal size hanging folders. The difference between the two sets of supports is that supports S2 have an increased horizontal spacing relative to supports S1. Therefore when supports S2 are used, the file supporting rails 29 when supported in position are spaced by a greater distance than when supports S1 are used. This is consistent with the fact that legal size folders are larger than letter size folders.

Each frame member construction is somewhat wedge shaped with the supports S1 and S2 extending laterally from the wedge. The wedge in each of the frame members includes a first transverse end rod 5 at the short end of the frame member, a second transverse end rod 7 at the longer end of the frame member and a pair of side rods 9 which angle outwardly from the short to the long end of the frame member. The side rods include bent end portions 11 and 13 at the short and long ends of the frame members respectively. These bent end portions are welded to the outer ends of the transverse rods and cooperate in forming the sets of supports S1 and S2.

Figure 10:
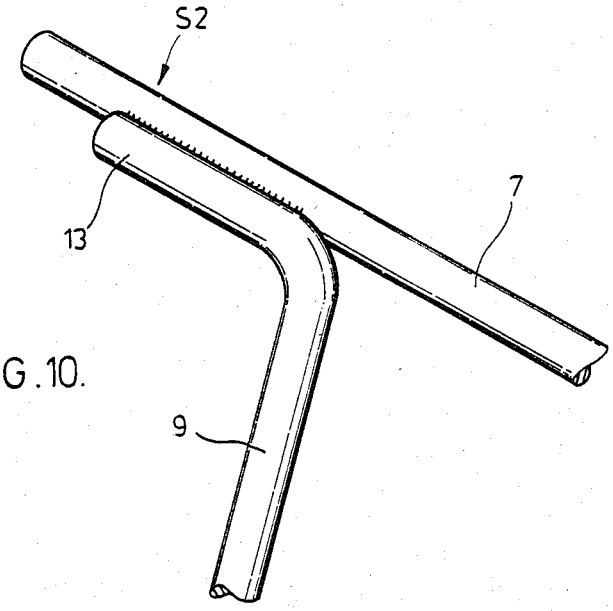
FIG. 10 is an enlarged perspective view of one of the connecting member supports of the frame members of FIGS. 2 and 3.

A typical support S2 is shown in FIG. 10 of the drawings. Here it will be seen that the bent end portion 13 of side rod 9 is welded directly to the outer end region of transverse rod 7 in forming the support S2. It will also be seen that the transverse rod extends slightly beyond end portion 13 of the side rod. Each of the supports is deliberately set up in this same manner where the transverse end rod projects outwardly beyond the bent ends of the side rod. The purpose for this construction is that the transverse rod has a fixed length and therefore provides an accurate guide for the maximum span across the sets of supports at either end of each frame member. This feature is highly desirable to assure that the arrangement is assembled at an accurate spacing for receiving the different sizes of hanging folders.

FIG. 10 also shows the feature that both the side rods and the end rods are cylindrical with a rounded or circular configuration. FIG. 6 shows one of the connecting members 15 which is adapted to fit to the support as shown in FIG. 10. More specifically each of the connecting members includes stem portion 17 and a head 21. The stem portion has a pair of side by side semi-circular openings 19 which are designed for pushing of the stem over any one of the supports. As will be seen in FIG. 6, the interior of the stem includes a stop 20 which is designed to abut against the extending end of the projecting rod at each support. This provides an accurate locating of each of the connecting members which are fitted as endcaps over the supports to either side of the upright frames or support members.

Figure 9:
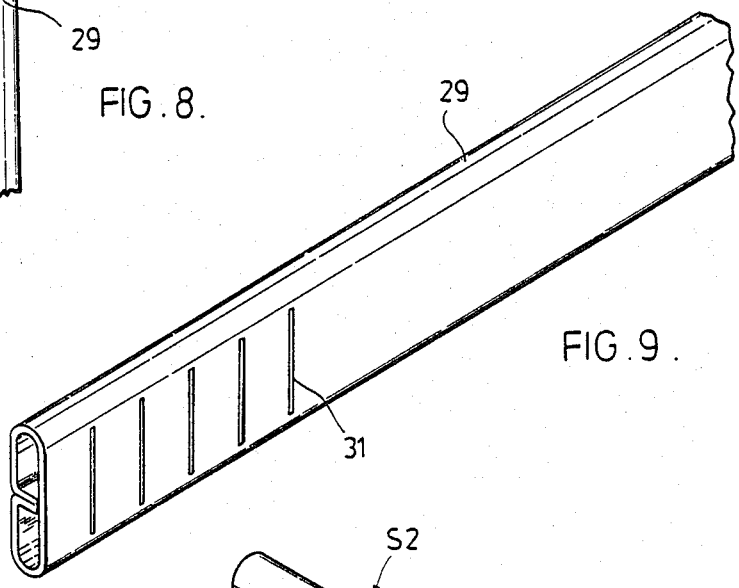
FIG. 9 is a perspective view of a section of one of the rails used in the folder hanger arrangement of FIGS. 2 and 3.

Each of the connecting member heads 21 is provided with a blind ended opening or recess 23. Recess 23 is designed to receive the rail members 29 as shown in FIG. 9 which are pushed directly into the head of the connecting members. This as well as the interconnection between the connecting members and the supports is in the form of a friction fit where the components lock tightly onto one another to ensure that once the system is assembled it does not slide apart. As a preferred feature of the present invention, the connecting members or endcaps are made from a plastic or nylon material which is particularly suited for the force fitting of the components to one another.

It will now be understood how the selective assembly of the arrangement is accomplished. For example, in order to assemble the arrangement as shown in FIG. 2, the upright support structure frames are turned such that supports S1 are in an up position. The caps or connecting members 15 are pushed onto these sets of supports with all of the heads on the caps positioned such that the blind ended openings 23 face inwardly with the rails 29 fitted in the caps.

For purposes of arranging the FIG. 3 assembly the endcaps with the fitted rails are pulled from the sets of supports S1. The frame members are inverted so that supports S2 are in an up position and the caps and rails are pushed back into position on the now up supports S2. It will be noted that the sets of supports in the down position act as feet at the base of the assembly.

In order to assemble the arrangement for metric size folders the sets of supports S1 are used in the up position and a plug 25 as shown in FIG. 7 is interfitted between the supports and the rail caps. This plug is placed within the opening 19 of the rail cap and effectively acts as a spacer between the stop 20 within the rail cap and the end of the support as shown in FIG. 11. FIG. 12 shows the fitting of the cap on the support in dotted lines for a letter size hanging folder and in solid lines for a metric size hanging folder. Here it will be seen that the endcap is located in a laterally extended position for the metric folders relative to the letter size folders which is due to the fact that the metric folders are larger than the letter folders.

It is to be appreciated that other types of metric plugs can be used. For example, a single plug is equally effective for fitting into the endcap between the end of the straight rod and the interior stop within the cap, where as mentioned above, the straight rod provides the accurate guide for positioning of the endcap.

One of the very unique and desirable features of the present invention is that all three of the assemblies described above, i.e. the letter, metric and legal size assemblies, require only a minimum number of components including the two rails, the four endcaps and the adaptor plugs with the endcaps being moveable to either end of the frame members. Furthermore the frame members themselves do not have any moving components and are therefore economic in their own construction while at the same time being extremely sturdy.

Figure 8:
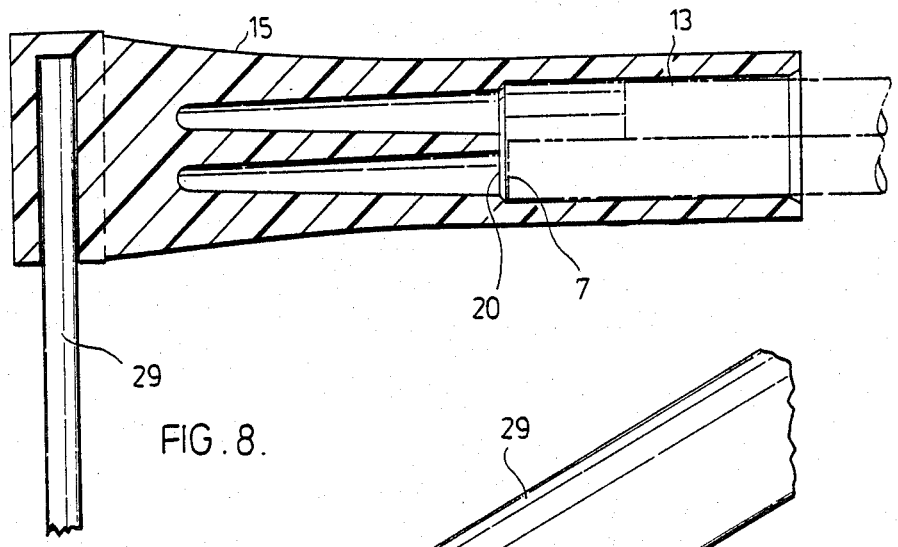
FIG. 8 is an interior view of the assembly at the connecting member when connecting the support frame and one of the rails of the folder hanger arrangement.

In most applications the folder hanger arrangement will be used within a filing cabinet. For this purpose the rails, as shown in FIG. 9, are constructed for easy length selection according to the depth of the filing cabinet. More specifically the rails are provided with a plurality of weakened notched regions 31 to one end of the rails allowing the rails to be trim or broken along the notches. The rail itself has a rolled form construction as shown in FIG. 9 so that it is very strong to support substantial loads placed on the rail while at the same time the rail has a hollow interior to ease the cutting or breaking of the rail at a desired length. The rail has an oval shape which will frictionally fit within the endcaps as shown in FIG. 8 of the drawings. However other shapes such as a rectangular rail and correspondingly shaped opening in the cap can also be used.

When the assembly is set up for legal size hanging folders as shown in FIG. 3, and that assembly is fitted into a legal size filing cabinet as shown in FIG. 4, the wide end of the arrangement is up and the narror end of the arrangement is down. Therefore this assembly presents no problems whatsoever to fitting within the wider legal size filing cabinet. However, the fitting into a letter size drawer as shown in FIG. 5 has more critical considerations. Specifically when the frame members are inverted the wider sets of supports S2 must be narrow enough to fit within the base of the filing cabinet and accordingly these sets of supports have a span which must be no greater than the span across the endcaps when they are set up at the narrower sets of supports S1. In the embodiment shown the distance between the rails when set up for letter size files is slightly greater than the lateral span at the base of the system with the S2 supports in the down position.

Figure 13:
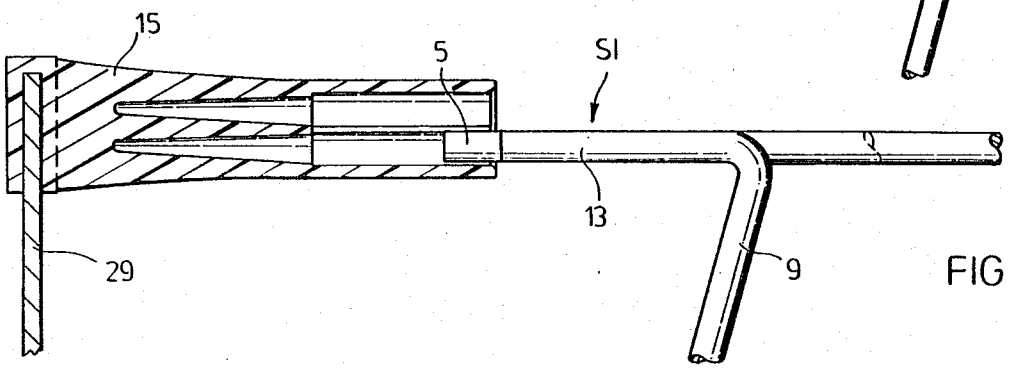
FIG. 13 shows assembly of one of the connecting members, one of the rails and a support of one of the upright support frame members when in an assembled packaging position.
Figure 14:
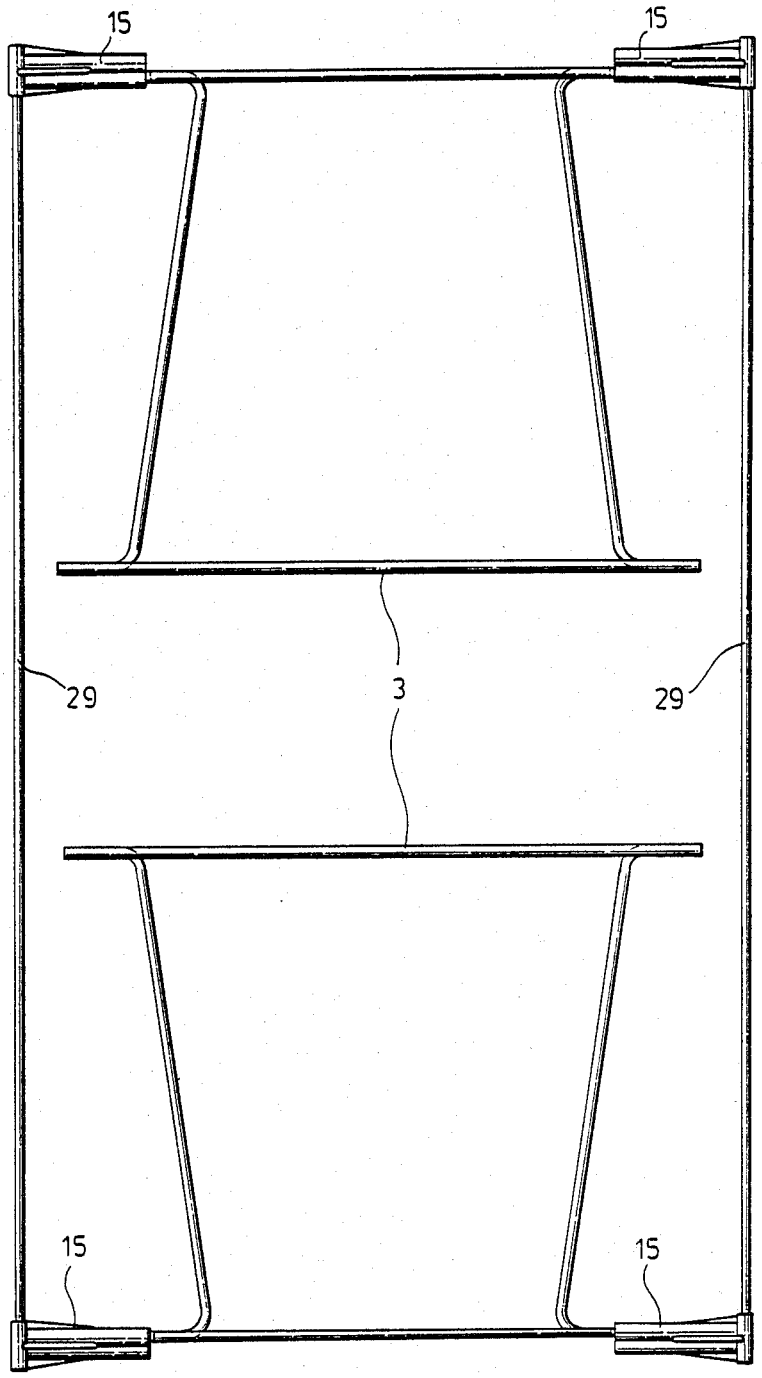
FIG. 14 is a plan view of the entire folder hanger arrangement assembled in the packaging position.

As most manufacturers will appreciate, many consumers do not like purchasing unassembled items. Accordingly the embodiment of the invention shown in FIGS. 13 and 14 provides a packaging assembly of the frame members, rail caps and rails. In this set up either of the sets of supports can be used however, it is more practical to use the narrower sets of supports S1 to allow a narrower packaging. In this packaging assembly the projecting end of rod 5 at each of the supports S1 is partially seated in the endcap as shown in FIG. 13 where the bent end portion of the side rod remains totally out of the stem of the cap. The rails 29 are totally seated in position within the heads of the endcaps.

This partial fitting of the supports in the caps is a first stage fitting which allows the frame members to be swung into the FIG. 14 position where they lie in the same plane as the rails 29. This of course enables a relatively flat box to be used for packaging in this position. After removing from the package or box the frame members are swung down to their upright positions by virtue of the fact that only the single extension at each of the supports is seated in position and that single extension through its circular or rounded shape will allow rotation within the correspondingly shaped opening at the stem of the caps. After the frame members have been turned down to the appropriate position the entire support including the inwardly located bent end of the side rod is lined up with the full opening in the stem of the caps for the second of the two stage fitting where the caps are pushed entirely onto the supports such that the frame members are locked against any further swinging movements.

From the description above it will be well appreciated that the folder hanger arrangement of the present invention is one which can be easily assembled, broken down and reassembled without requiring any tools whatsoever. Furthermore the locking together of the components is not dependent upon any complicated locking actions so that the arrangement is not subject to jamming of the components. In addition the accuracy of the location of the components is ensured by simply assembling the structure as shown in FIG. 8 where the ends of the rails are seated as far as possible into the heads of the caps and the supports of the frames are pushed into the stop position within the stems of the rail caps.

From a versatility standpoint the folder hanger arrangement of the present invention is adapted such that it will work in both legal and letter size drawers so that it will fit with essentially any presently available filing system. Furthermore the dimensions of the arrangement can be quite easily altered through the use of different sizes of adaptor plugs to accommodate different types and sizes of filing systems from those described above.

Therefore, although various preferred embodiments of the present invention have been described herein in detail it will be appreciated by those skilled in the art that variations may be made thereto without departing from the spirit of the invention or the scope of the appended claims.

The embodiments of the invention in which an exclusive property or privilege is claimed are defined as follows:

1. An arrangement comprising a pair of invertible frame members in combination with a single pair of side rails for hanging of hanging folders from the side rails and connecting members for connecting the side rails to said frame members, each said frame member being free of moving parts and when upright, having vertically spaced ends with a first pair of horizontally spaced supports at one of said ends and a second pair of horizontally spaced supports of different spacing from said first pair of supports at the other of said ends, said connecting members being removeable from said frame member for fitting at either of said first and second pairs of supports, each said frame member being of fixed configuration to provide for preset spaced support of the side rails by said first pair of horizontally spaced supports with the connecting members fitted on said first pair of supports in a first spaced relation in one upright orientation of the frame member and to provide for preset spaced support of the side rails by said second pair of horizontally spaced supports with the connecting members fitted on said second pair of supports in a second spaced relation different from the first spaced relation when the frame member is inverted.

2. An arrangement as claimed in claim 1 wherein said connecting members are constructed to push on and pull off said frame member at said first and said second pairs of supports.

3. An arrangement as claimed in claim 2 wherein each of said connecting members includes a rail receiving portion provided with a blind ended opening for slideably receiving and frictionally securing an end of one of the siderails.

4. An arrangement as claimed in claim 2 wherein the supports of both said first and second pairs of supports all comprise side by side cylindrical rod portions and each of said connecting members is provided with a blind ended opening for sliding over and frictionally fitting to said side by side cylindrical rod portions.

5. A knockdown folder hanger arrangement for selective assembly to hang letter size or legal size hanging folders in letter size or legal size filing cabinets respectively, said arrangement comprising two substantially identical upright support frame members free of moving parts, four substantially identical connecting members removeable from said frame members and a single pair of elongated rails which, when the arrangement is assembled, are fitted in the conecting members spaced fronm one another supported to either side of said frame members which are of a fixed configuration to receive said rails at a preset spacing from one another, each of said frame members having vertically spaced ends with a first set of spaced supports at one of the ends and a second set of spaced supports at the other of the ends, the first set of supports being of lesser spacing than the second set of supports and each frame member being invertible to switch the first and second sets of supports between an up and a down position with said connecting members being arranged for movement at both frame members away from the sets of supports in the down position and to the sets of supports in the up position whereby when the first sets of supports of both frame members are in the up position with the connecting members on the first sets of supports the rails are assembled at a first rail spacing to hang the letter size hanging folders and when the frame members are inverted such that the second sets of supports of both frame members are in the up position with the connecting members on the second sets of supports, the rails are assembled to hang the legal-size hanging folders; the lateral span of said second sets of supports being no greater than the first rail spacing for fitting of the system in the letter-sized filing cabinet when assembled for the letter size hanging file folders.

6. A knockdown folder hanger arrangement as claimed in claim 5 including adaptors for fitting into said connecting members for supporting said rails to hang folders of sizes other than letter and legal size.

7. A knockdown folder hanger arrangement as claimed in claim 5 including adaptors for fitting with said connecting members when said first sets of supports are in the up position for assembling said rails to hang metric size hanging folders.

8. A knockdown folder hanger arrangement as claimed in claim 5 wherein at least one of said sets of supports on each frame member and said connecting members are adapted to cooperate for a two stage fitting including a first stage in which said connecting members are pivotal on said one of said sets of supports for assembled packaging and for pivoting of said connecting members with the rails fitted therein to a second stage for hanging of the hanging folders.

9. A knockdown folder hanger arrangement as claimed in claim 5 wherein said first and said second sets of supports comprise lateral projections to either side of said frame members and wherein said connecting members comprise caps for pushing on and pulling off of said lateral projections, said caps being provided with openings for slideably receiving and frictionally securing said rails.

10. A knockdown folder hanger arrangement as claimed in claim 5 wherein each of said frame members has a narrow end at said first set of supports and a wide end at said second set of supports, each of the wide and narrow ends being spanned by transverse members which determine maximum width across the respective ends for ensuring accurate locating of the rail connecting members for connecting the rails to the frame members in proper positions for hanging the letter and the legal size hanging folders.

11. A knockdown folder hanger arrangement as claimed in claim 8 wherein said one of said sets of supports on each frame member comprises a pair of side by side lateral substantially circular projections with one of said projections extending outwardly beyond the other of said projections, said connecting members comprising caps having a pair of side by side substantially semicircular recesses for fitting said connecting members to said projections, the one extending projection providing the first stage of the two stage fitting with the connecting members being pivotal on the one projection for alignment of both projections with the side by side recesses in the connecting members for push fitting the connecting members to the second stage of the two stage fitting.

12. A knockdown folder hanger arrangement as claimed in claim 6 wherein said adaptors comprise plugs for interfitting between said connecting members and said first sets of supports on said frame members for hanging the metric size file folders.

13. A knockdown folder hanger arrangement as claimed in claim 5 wherein said rails are roll formed.

14. A knockdown folder hanger arrangement as claimed in claim 12 wherein said rails are hollow and weakened near one end for trimming of the rails to a desired length.

15. An arrangement as claimed in claim 10 wherein each frame member comprises a pair of first generally upright rod portions having outwardly bent outer ends and a pair of second transverse rod portions projecting outwardly beyond the outer ends of said upright rod portions, said second transverse rod portions both supporting the fixed construction of each frame member and providing a guide for the preset spacing of said elongated rails.

* * * * *